US011794954B2

(12) United States Patent
Schmetzer et al.

(10) Patent No.: US 11,794,954 B2
(45) Date of Patent: Oct. 24, 2023

(54) PACKAGING UNIT

(71) Applicant: OPTIMA nonwovens GmbH, Schwäbisch Hall (DE)

(72) Inventors: Dietmar Schmetzer, Michelbach (DE); Georg Pfeifer, Schwäbisch Hall (DE); Klaus Griessmayr, Rosengarten-Rieden (DE)

(73) Assignee: OPTIMA nonwovens GmbH, Schwäbisch Hall (DE)

( * ) Notice: Subject to any disclaimer, the term of this patent is extended or adjusted under 35 U.S.C. 154(b) by 688 days.

(21) Appl. No.: 16/091,849

(22) PCT Filed: Mar. 28, 2017

(86) PCT No.: PCT/EP2017/057260
§ 371 (c)(1),
(2) Date: Jan. 7, 2019

(87) PCT Pub. No.: WO2017/174395
PCT Pub. Date: Oct. 12, 2017

(65) Prior Publication Data

US 2020/0189799 A1 Jun. 18, 2020

(30) Foreign Application Priority Data

Apr. 7, 2016 (DE) ..... 102016205758.8

(51) Int. Cl.
*B65D 71/06* (2006.01)
*B65D 33/02* (2006.01)
*B65D 75/52* (2006.01)

(52) U.S. Cl.
CPC ..... *B65D 33/02* (2013.01); *B65D 71/066* (2013.01); *B65D 75/525* (2013.01)

(58) Field of Classification Search
CPC ..... B65D 33/02; B65D 71/066; B65D 71/10; B65D 71/06; B65D 71/063; B65D 75/004;
(Continued)

(56) References Cited

U.S. PATENT DOCUMENTS 3,425,544 A * 2/1969 Ayer ..... B65D 71/10 206/497
3,761,289 A 9/1973 Wolf
(Continued)

FOREIGN PATENT DOCUMENTS

DE 18 35 788 U 7/1961
DE 78 02 978 U1 5/1978
(Continued)

OTHER PUBLICATIONS

Examination Report dated Mar. 3, 2020 issued in connection with corresponding European Patent Application No. 17715074.5.
(Continued)

*Primary Examiner* — Jes F Pascua
*Assistant Examiner* — Nina K Attel
(74) *Attorney, Agent, or Firm* — Akerman LLP

(57) ABSTRACT

The invention relates to a packaging unit (1) for a plurality of individual products (20) combined into a group (2), comprising a plastic bag which accommodates the group (2) of individual products (20) and at least one stiffening element (3, 4, 5) arranged in the plastic bag or around the plastic bag, wherein the at least one stiffening element (3, 4, 5) covers and/or accommodates at least one of the plurality of individual products at least in some sections and wherein the at least one stiffening element (3, 4, 5) is produced from a material having a higher stiffness than the plastic bag.

1 Claim, 5 Drawing Sheets

(58) Field of Classification Search
CPC .. B65D 75/525; B65D 71/0088; B65D 71/08; B65D 85/07
USPC ..... 383/2, 119; 206/597, 440
See application file for complete search history.

(56) References Cited

U.S. PATENT DOCUMENTS

| | | | | |
|---|---|---|---|---|
| 4,535,587 | A | 8/1985 | Rias | |
| 4,709,851 | A | 12/1987 | Vanasse | |
| 5,934,470 | A | 8/1999 | Bauer et al. | |
| 7,793,779 | B2 * | 9/2010 | Spivey, Sr. | B65D 71/10 206/153 |
| 2003/0070396 | A1 | 4/2003 | Lam et al. | |
| 2005/0121348 | A1 * | 6/2005 | Clare | B65D 71/10 206/440 |
| 2006/0196796 | A1 | 9/2006 | Motsch et al. | |
| 2006/0196797 | A1 | 9/2006 | Motsch et al. | |
| 2008/0156681 | A1 | 7/2008 | Albrecht et al. | |
| 2011/0162991 | A1 * | 7/2011 | Albrecht | B65D 85/08 206/443 |

FOREIGN PATENT DOCUMENTS

| | | | | |
|---|---|---|---|---|
| DE | 28 04 370 | A1 | 8/1979 | |
| GB | 2013607 | A * | 8/1979 | B65D 71/10 |
| JP | 2008-265807 | A | 11/2008 | |
| KR | 20-0440965 | Y1 | 7/2008 | |

OTHER PUBLICATIONS

International Search Report dated May 24, 2017 issued in connection with PCT/EP2017/057260.
German Search Report dated Jan. 11, 2017 issued in connection with corresponding German Patent Application No. 10 2016 205 758.8.

* cited by examiner

PACKAGING UNIT

CROSS-REFERENCE TO RELATED APPLICATIONS

This application is a national phase of PCT/EP2017/057260, filed Mar. 28, 2017, and claims priority to DE 10 2016 205 758.8, filed Apr. 7, 2016, the entire contents of which are hereby incorporated by reference.

The invention relates to a packaging unit for a plurality of individual products, comprising a plastic bag which accommodates the individual products.

Plastic bags, also designated poly bags, film bags or flat bags, are used for packaging an extremely wide range of individual products because of their low weight and their low price, the plastic bags being filled with the individual products.

However, if the individual products put into the plastic bags have a shape in which at least one side is corrugated, inclined, curved or otherwise uneven and/or the individual products have an anisotropic structure or an anisotropic construction, for example individual products having regions which differ in their stiffness, strength and/or hardness, then, as a rule, the filled plastic bag has a non-uniform shape. This results in the packaging units being arranged crookedly on sales counters or in sales shelves and thus creating a disordered, unattractive impression.

OBJECT AND ACHIEVEMENT

The object of the invention is, therefore, to devise a packaging unit for a plurality of individual products, comprising a plastic bag which accommodates the individual products, which has adequate stability and permits attractive presentation on a sales counter and/or in sales shelves.

This object is achieved by a packaging unit for a plurality of individual products combined into a group, comprising a plastic bag which accommodates the group of individual products and at least one stiffening element arranged in the plastic bag or around the plastic bag, wherein the at least one stiffening element accommodates at least one of the plurality of individual products at least in some sections, and wherein the at least one stiffening element is produced from a material having a higher stiffness than the plastic bag.

The individual products are grouped for packaging. In connection with the application, grouping designates a type of assembly of a plurality of individual products that is matched to the respective individual product. Depending on the type of the individual product to be packaged, a uniform or alternating alignment of the individual products in one or more rows, single-layer or multiple-layer, is thus provided.

In one refinement, the group is stabilized by means of the at least one stiffening element, and the ensemble thus created is guided into a plastic bag, or a plastic bag is slipped over the ensemble thus created. In other refinements, the group of individual products is inserted into the plastic bag and the stiffening element is fitted to an outer side of the plastic bag filled with individual products.

The at least one stiffening element is preferably made of a blank of a flat material. Conceivable materials for the stiffening element are, for example, plastic, wood, wood fiber materials, paper, paperboard and the like. The stiffening element produced from a flat material has at least one smooth surface, which can be used as a support surface or as a visible surface for a sales presentation. Depending on the requirements, the blank can be folded and/or shaped in another way.

The stiffening element or elements effect stabilization of the packaging unit and compensate irregularities in an outer shape of the group of individual products. By means of the stiffening element or elements in combination with the plastic bag, a packaging unit is created which, visually and in terms of handling, resembles a carton. The stiffening element is preferably configured suitably to create an at least substantially cube-shaped packaging unit. Packaging units of this type are suitable for an esthetically attractive uniform presentation.

A packaging unit of this type is suitable in particular for packaging diapers or similar individual products having only low dimensional stability.

In one refinement, the at least one stiffening element is configured as a lid, which is arranged on one side of the group of individual products. Lid designates an element which has a flat side and a plurality of wings projecting from said flat side. Preferably, a cube-shaped lid having a rectangular flat side and four wings projecting from the flat side is provided. In one refinement, the wings are connected at their mutually adjacent sides, so that a container-like structure is created. In other refinements, in particular if the stiffening element is inserted into the plastic bag, the wings are at least partly not connected to one another.

In an advantageous refinement, two lids arranged on opposite sides of the group of individual products are provided. The lid or the lids can be arranged on any desired sides of the group. In order not to make removal of the individual products difficult or only insignificantly so, the at least one lid is arranged on an upper side used for a removal of the products during regular use and/or an underside of the group of individual products opposite said upper side. The lid arranged on an upper side can be removed in a simple way when the packaging unit is first opened. Removal of the individual products out of the packaging unit is not influenced by the lid arranged on an underside. In other refinements, the lids are arranged on the group of individual products such that they make contact only with the individual products arranged at the ends of a row of individual products, removal of the individual products from the packaging unit being possible from a center of the row of individual products without removing the stiffening element.

In an alternative refinement, the at least one stiffening element is configured as a wrapper completely or partly surrounding the group of individual products. The wrapper is combined with a lid in one refinement. In another refinement, instead of a lid, one or more wrappers is/are provided. Here, in connection with the application, wrapper designates a strip-like element which extends wholly or partly over at least two mutually adjacent sides of the group of individual products, preferably over three mutually adjacent sides. The wrapper is closed in one refinement and extends over an entire extent of the group of individual products. In other refinements, the wrapper is open and has two free ends. The wrapper can be placed around the group of individual products in an extremely wide range of ways, wherein respectively a plurality of individual products or only one individual product from the group of individual products is covered by the wrapper.

In one refinement, the at least one wrapper extends along an upper side used for a removal of the products during regular use and/or an underside of the group of individual products opposite said upper side. If the section of the wrapper extending along the upper side is continuous, this section must be separated for removal of the products when the packaging unit is first opened. In other refinements, the wrapper is unclosed.

Alternatively or additionally, in another refinement, the at least one wrapper extends along a front side provided for a sales presentation and/or a rear side of the group of individual products opposite said front side.

The at least one wrapper is unclosed in one refinement and has two free ends, wherein the free ends project over one side of the group of individual products or are bent over to the side. The projecting ends in one refinement serve as standing feet for a sales presentation. Alternatively, the projecting ends can be arranged on an upper side and function as carrying handles for handling the packaging unit.

In one refinement, exactly one wrapper is provided, wherein at least one section of the wrapper has a width which corresponds to a width of an associated side of the group of individual products, wherein at least one wing extending at least partly over an adjacent side is preferably provided on the section. By means of the at least one wing, additional stabilization is achieved, which is also advantageous in particular when stacking the packaging units.

In another refinement, a plurality of wrappers are provided, wherein each wrapper surrounds at least one individual product from the group of individual products in the manner of a frame. The individual wrappers can extend parallel to one another or cross one another. It is also conceivable to combine closed and unclosed wrappers with one another.

BRIEF DESCRIPTION OF THE DRAWINGS

Further advantages and aspects of the invention can be gathered from the claims and from the following description of preferred exemplary embodiments of the invention, which are explained below by using the figures, in which:

DETAILED DESCRIPTION OF THE EXEMPLARY EMBODIMENTS

Figure 1:
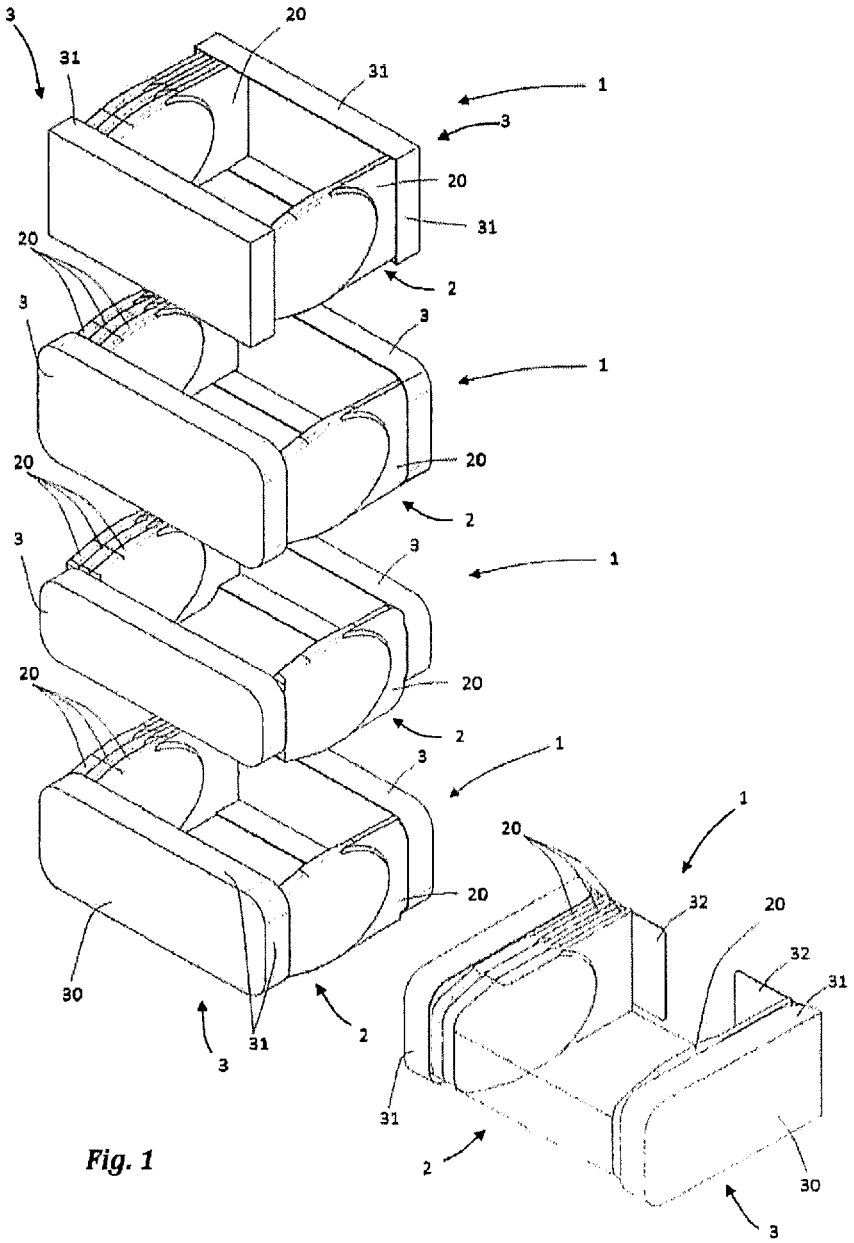
FIG. 1 shows a schematic illustration of five different packaging units, each having two stiffening elements configured as lids.

FIGS. 1 to 5 show different packaging units 1. The packaging units 1 are each used for packaging a group 2 of individual products 20. In the exemplary embodiments illustrated, each group 2 comprises a plurality of individual products 20 arranged in a row with the same orientation. However, this arrangement of the individual products is merely exemplary. Depending on the individual product and/or pack size, the individual products 20 can also be grouped in a plurality of parallel rows and/or in a plurality of layers. For an improved overview, the individual products 20 of each group 2 are not illustrated completely. The individual products 20 are, for example, diapers. However, the invention is not restricted to use of the packaging unit 1 for packaging diapers.

The packaging units 1 each comprise a plastic bag, not illustrated in the figures, and at least one stiffening element 3, 4, 5, wherein the at least one stiffening element 3, 4, 5 covers and/or accommodates at least one of the plurality of individual products 20 at least in some sections. By means of the stiffening elements 3, 4, 5, stabilization of the packaging unit 1 is achieved, so that the packaging units 1 can be set up in an esthetically attractive manner, in particular for a sales presentation. The stiffening elements 3, 4 or 5 can each be arranged in the plastic bag and, for example, can be put into the plastic bag as a unit with the group 2 of individual products 20. Alternatively, the stiffening elements 3, 4 or 5 can each be arranged on an outer side of the plastic bag.

In the exemplary embodiments illustrated in FIGS. 1 to 5, the stiffening elements 3, 4, 5 supplement or equalize irregularities on outer contours of the group 2 of individual products 20, so that an at least substantially cube-shaped packaging unit 1 is created.

FIG. 1 shows five different packaging elements 1, each having two stiffening elements configured as lids 3 in schematic illustrations.

In the packaging units 1 illustrated on the left 1 in FIG. 1, the stiffening elements configured as lids 3 are each arranged on an upper side used for a removal of the individual products 20 during regular use, and on an underside of the group 2 of individual products 20 opposite said upper side. In the embodiments shown on the left in FIG. 1, the lids 3 each have an at least substantially cube-shaped basic form, wherein the corners of the lids 3 are partly rounded.

In the embodiments illustrated on the left in FIG. 1, the lids 3 each have a flat side 30 and four wings 31 projecting from the flat side 30, wherein the wings 31 are connected at their mutually adjacent sides, so that a container-like structure is created. With the exception of the configuration illustrated as the third from the top, ends of the individual products 20 that are arranged on the upper side or the underside are inserted into the lids 3. The individual products 20 to some extent have projections at these ends, wherein the shape and/or size of the lids 3 can be adapted to the shape of the individual products 20. In the configuration illustrated as the third from the top, a lid 3 illustrated on the left is arranged only on the side of the individual products 20, without the ends of the individual products 20 being inserted into the lid 3. Instead of a lid 3, only a plate-like stiffening element can also be provided.

In the packaging unit 1 illustrated on the right in FIG. 1, the stiffening elements configured as lids 3 are arranged on a side of the group 2 of individual products that is arranged on the left and right during a removal during regular use. The lids 3 of the packaging unit 1 illustrated on the right in FIG. 1 likewise have a flat side 30 and four wings 31, 32, but wherein a lid 32 is not in each case connected to the adjacent wings 31 at its sides. The wing 32 can thus be pivoted in relation to the flat side 30. In an alignment illustrated in FIG. 1, in which the wings 32 are folded over toward the group 2, the wings 32 serve to stabilize and/or improve planarity of the corresponding side of the group 2 of individual products 20, For a removal of the individual products from this side, the wings 32 can be retracted from the side.

Figure 2:
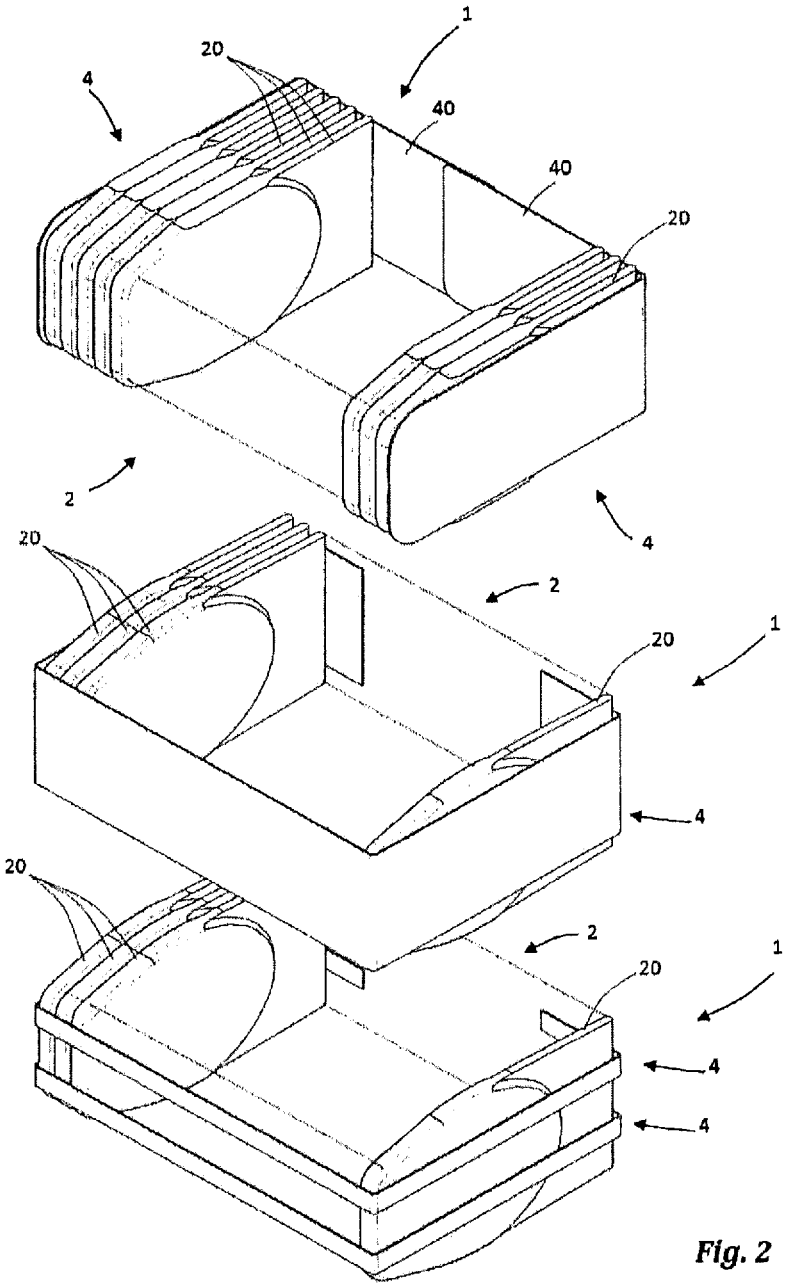
FIG. 2 shows a schematic illustration of three different packaging units, each having one or two stiffening element(s) configured as (a) wrappers(s)

FIG. 2 shows three different packaging units 1, each having one or two stiffening element(s) configured as (a) wrappers(s) 4 in schematic illustrations.

In the packaging unit 1 illustrated at the top in FIG. 2, two stiffening elements configured as L-shaped wrappers 4 are arranged on a side of the group 2 of individual products 20 that is arranged on the left and right during a removal during regular use, wherein in each case one limb 40 of the wrappers 4 extends relative to an upper side used for a removal of the individual products 20 during regular use and/or an underside of the group 2 of individual products 20 opposite said upper side. If the limbs 40 are arranged on an upper side, these can be pivoted for a removal, so that access to the individual products 20 is possible.

In the packaging unit 1 illustrated in the middle in FIG. 2, a stiffening element configured as a wrapper 4 is provided. The wrapper 4 extends over the side of the group 2 of individual products 20 that is arranged on the left and right during a removal during regular use, and also over the upper side used for a removal of the individual products 20 during regular use and/or an underside of the group 2 of individual products 20 opposite said upper side. The wrapper 4 is not closed but has two free ends. The free ends are arranged on the upper side, for example, so that the wrapper 4 does not hamper or only insignificantly hampers a removal of the individual products by a user.

The packaging unit 1 illustrated at the bottom in FIG. 2 is similar to the packaging unit 1 illustrated in the middle, two stiffening elements configured as wrappers 4 being provided. Here, the two wrappers 4 have a lower width than the one wrapper 4 of the embodiment illustrated in the middle. It is obvious to those skilled in the art that, of course, more than two wrappers 4 can also be provided.

Figure 3:
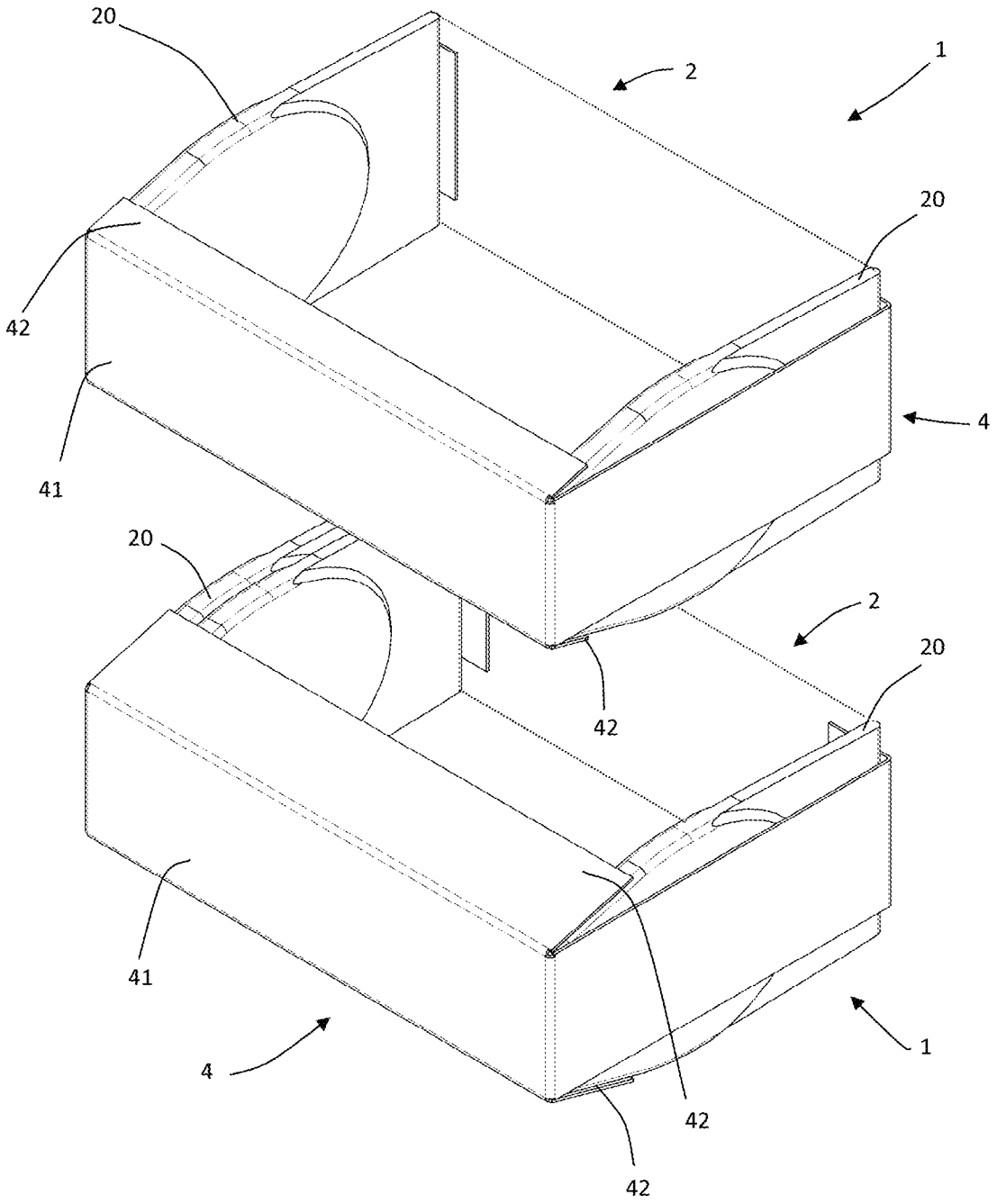
FIG. 3 shows a schematic illustration of two different packaging units, each having a stiffening element configured as a wrapper, wherein one section of the wrapper has wings.

FIG. 3 shows schematic illustrations of two different packaging units 1, each having a stiffening element configured as a wrapper 4, wherein one section 41 of the wrapper 4 has wings 42.

The packaging units 1 illustrated in FIG. 3 are similar to the packaging unit 1 illustrated in the middle in FIG. 2. On one section 41 of the wrapper 4, two wings 42 extending on the adjacent sides are provided. The section 41 having the wings 42 is preferably arranged on an underside of the group 2 of individual products 20, which side is opposite an upper side used for a removal of the individual products 20 during regular use. By means of the wrappers 4 according to FIG. 3, a stiffening element extending at least partly over all of the sides of the group 2 of individual products 20 is created, so that virtually complete stabilization is achieved.

Figure 4:
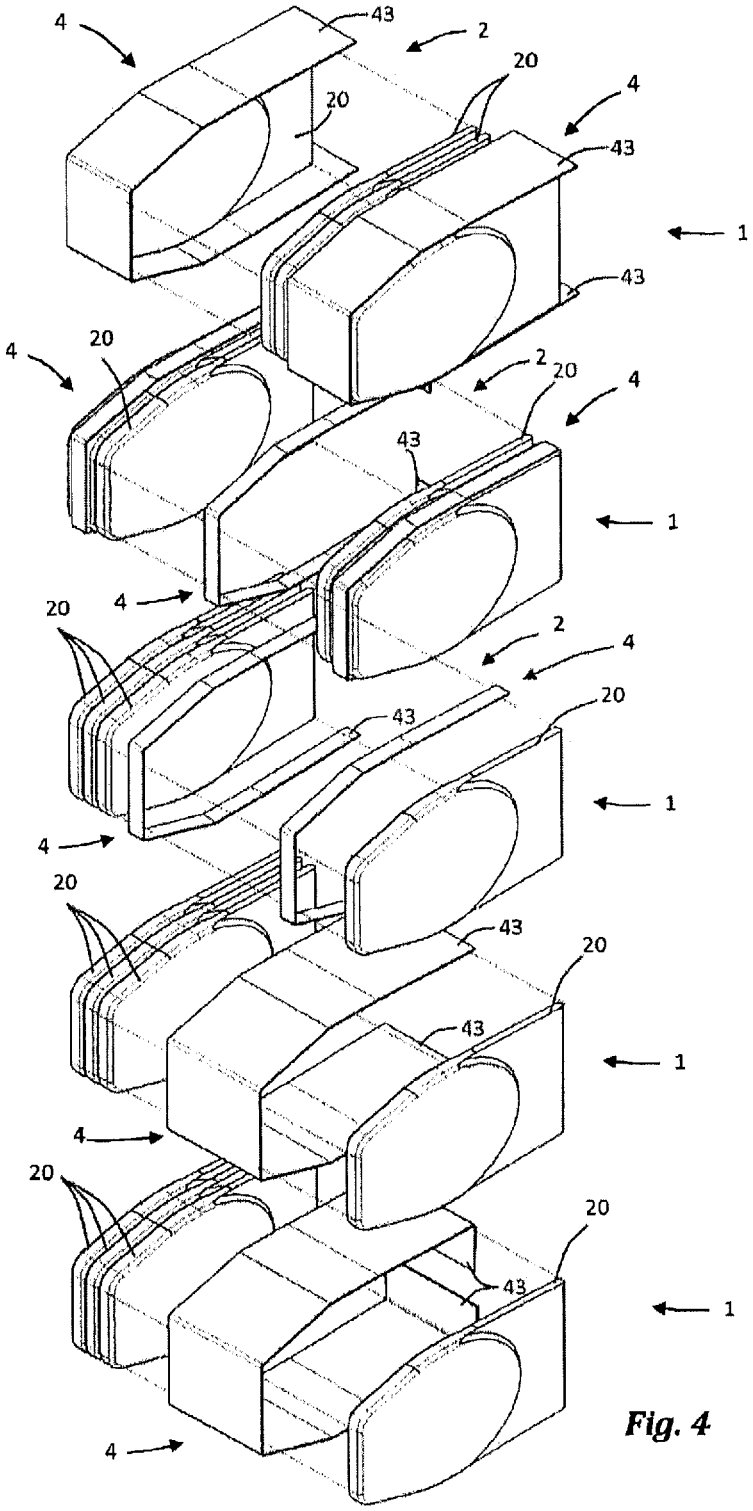
FIG. 4 shows a schematic illustration of five different packaging units, each having one or two stiffening element(s) configured as (a) wrappers(s), which surrounds an individual product or a plurality of individual products on three sides in the manner of a frame.

FIG. 4 shows five different packaging units 1, each having one or two stiffening element(s) configured as (a) wrapper(s) in schematic illustrations. In the embodiments illustrated in FIG. 4, the wrapper 4 or the wrappers 4 each surround an individual product 20 or a plurality of individual products 20 from the group 2 of individual products 20 on three narrow sides of the individual products 20 in the manner of a frame. For example, the wrappers 4 each extend along the sides serving as the underside, front side and rear side of the packaging unit 1 during regular use. The wrappers 4 have two free ends, which project from a fourth side, for example an upper side, or are bent over relative to the latter.

In the packaging unit 1 illustrated at the top in FIG. 4, two respectively substantially U-shaped wrappers are provided, which are arranged on the two lateral ends of the group 2 of individual products 20 and each surround a plurality of individual products 20, for example three or four, from the group 2 of individual products 20 on three narrow sides of the individual products 20 in the manner of a frame. The wrapper 4 has two free ends 43, which project from a fourth side, for example an upper side.

In the packaging unit 1 illustrated as the second in FIG. 4, viewed from above, three substantially U-shaped wrappers 4 are provided, which are arranged on the two lateral ends of the group 2 of individual products 20 and in the center thereof and each surround an individual product 20 from the group 2 of individual products 20 on three narrow sides of the individual product 20 in the manner of a frame. The wrapper 4 has two free ends 43, which are bent over toward the fourth side, for example an upper side.

In the packaging unit 1 illustrated as the third in FIG. 4, viewed from above, two respectively substantially U-shaped wrappers 4 are provided, which are arranged at a distance from each other between the two lateral ends of the group 2 of individual products 20 and each surround an individual product 20 from the group 2 of individual products 20 on three narrow sides of the individual product 20 in the manner of a frame. The wrapper 4 has two free ends 43, which project from the fourth side, for example an upper side.

In the packaging unit 1 illustrated as the fourth in FIG. 4, viewed from above, a substantially U-shaped wrapper 4 is provided, which is arranged in the middle between the two lateral ends of the group 2 of the individual products 20 and surrounds a plurality of individual products 20 from the group 2 of individual products 20 on three narrow sides of the individual products 20 in the manner of a frame. The wrapper 4 has two free ends 43, which project from the fourth side, for example an upper side.

The packaging unit 1 illustrated at the bottom in FIG. 4 is similar to the packaging unit 1 illustrated as the fourth in FIG. 4, viewed from above, wherein the two free ends 43 of the wrapper are bent over toward the fourth side, for example an upper side.

Figure 5:
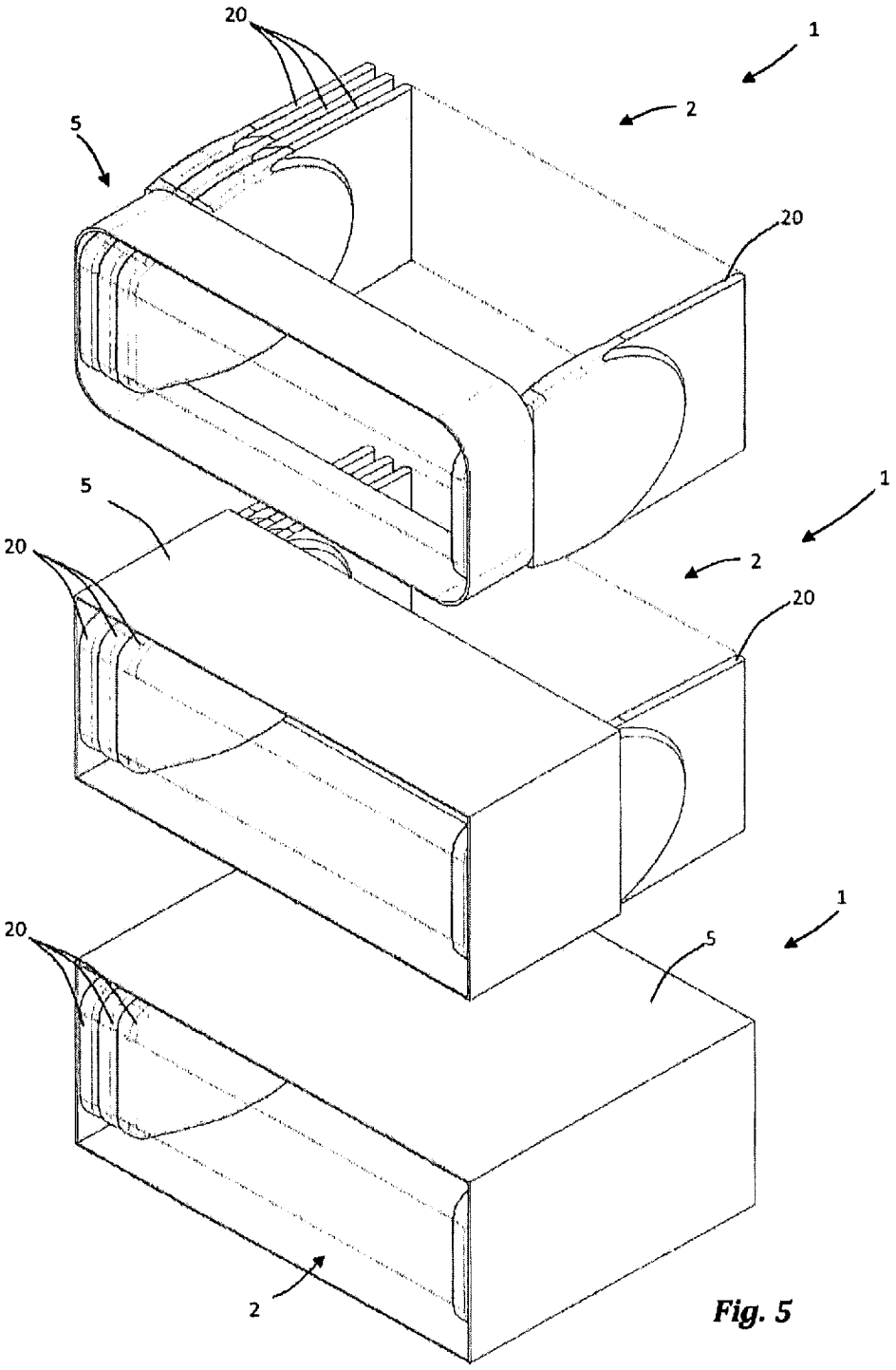
FIG. 5 shows a schematic illustration of three different packaging units, each having a stiffening element configured as a wrapper, wherein the wrapper encloses the group along a lateral surface.

FIG. 5 shows three different packaging units 1, each having a stiffening element configured as a closed or circumferential wrapper 5 in schematic illustrations, wherein the wrapper 5 encloses the group 2 of individual products 20 along a lateral surface. For example, the wrappers 5 each extend along the side serving as a front side, rear side and left-hand and right-hand side of the packaging unit 1 during regular use. The packaging units 1 illustrated in FIG. 5 differ in terms of a width of the wrappers 5 and in terms of a shape having sharp-edged or rounded corners.

As mentioned above, a stiffening element 3, 4 or 5 illustrated in FIGS. 1 to 5 can be arranged respectively in the plastic bag or on an outer side of the plastic bag. Preferably, the stiffening elements illustrated in FIGS. 1 to 4 and configured as lids 3 or wrappers 4 can be arranged on or attached to the group 2 of individual products 20 and put into the plastic bag with the latter. The stiffening elements according to FIG. 5 configured as circumferential wrappers 5, on the other hand, are preferably arranged on an outer side of the plastic bag.

The exemplary embodiments illustrated are merely exemplary and numerous modifications are conceivable. In particular, it is also conceivable to combine features of the exemplary embodiments with one another, in order thus to obtain further embodiments.

What is claimed is:

1. A packaged product comprising:

a plurality of diapers or similar individual hygiene products having only low dimensional stability combined into a group, wherein the individual hygiene products have one or both of a shape in which at least one side is corrugated, inclined, curved or otherwise uneven and an anisotropic structure or an anisotropic construction, wherein the group of diapers or similar individual hygiene products having only low dimensional stability has a top side, a bottom side opposite said top side, a left side, a right side, a front side, and a rear side opposite said front side, a packaging unit, the packaging unit comprising:

a plastic bag which accommodates the group of diapers or similar individual hygiene products having only low dimensional stability and a stiffening element which is provided in the plastic bag or around the plastic bag, wherein the stiffening element is manufactured from a material having a higher stiffness than the plastic bag, wherein the stiffening element is designed as exactly one wrapper which partially surrounds the group of diapers or similar individual hygiene products having only low dimensional stability, wherein the one wrapper is unclosed and has two free ends, wherein the one wrapper has a first section, a second section, and a third section, and extends over a full length of three adjacent sides of the group of diapers or similar individual hygiene products having only low dimensional stability, wherein the three adjacent sides are the top side or the bottom side, the left side, and the right side, wherein said first section runs along the top side serving for a removal of the products during regular use or the bottom side, opposite said top side, of the group of diapers or similar individual hygiene products having only low dimensional stability, and said second section and said third section run along the left side and the right side of the group of diapers or similar individual hygiene products having only low dimensional stability that are arranged on the left and right during a removal or during regular use, wherein said first section of the one wrapper has a width which corresponds to a width of the associated top side or bottom side of the group of diapers or similar individual hygiene products having only low dimensional stability, wherein said first section of the one wrapper is provided with at least one wing, wherein the at least one wing extends at least partially over the front side or the rear side of the group of diapers or similar individual hygiene products having only low dimensional stability, wherein the two free ends of the one wrapper project over the bottom side or top side, opposite said first section, of the group of diapers or similar individual hygiene products having only low dimensional stability or are bent over to the bottom side or top side, opposite said first section, of the group of diapers or similar individual hygiene products having only low dimensional stability, wherein said second section of the one wrapper has a width which is less than a width of the left side of the group of diapers or similar individual hygiene products having only low dimensional stability, wherein said third section of the one wrapper has a width which is less than a width of the right side of the group of diapers or similar individual hygiene products having only low dimensional stability, and wherein said second section and said third section are devoid of any wing extending over the front side or the rear side of the group of diapers or similar individual hygiene products having only low dimensional stability.

* * * * *